US009333505B2

(12) United States Patent
Streit et al.

(10) Patent No.: US 9,333,505 B2
(45) Date of Patent: May 10, 2016

(54) SETTING METHOD FOR MICROPLATE WASHING DEVICES

(75) Inventors: Wolfgang Streit, Hallein (AT); Juha Koota, Berchtesgaden (DE); Wolfgang Fuchs, Salzburg (AT)

(73) Assignee: TECAN TRADING AG, Mannedorf (CH)

( * ) Notice: Subject to any disclaimer, the term of this patent is extended or adjusted under 35 U.S.C. 154(b) by 837 days.

(21) Appl. No.: 13/357,080

(22) Filed: Jan. 24, 2012

(65) Prior Publication Data

US 2012/0199163 A1 Aug. 9, 2012

Related U.S. Application Data

(60) Provisional application No. 61/436,684, filed on Jan. 27, 2011.

(30) Foreign Application Priority Data

Jan. 27, 2011 (CH) ..... 135/11

(51) Int. Cl.
*B08B 7/04* (2006.01)
*B08B 7/00* (2006.01)
*B01L 99/00* (2010.01)

(52) U.S. Cl.
CPC ..... *B01L 99/00* (2013.01); *B01L 2200/08* (2013.01); *B01L 2200/14* (2013.01)

(58) Field of Classification Search
CPC .. B01L 2200/08; B01L 99/00; B01L 2200/14
USPC ..... 134/18, 26, 21, 22.18, 22.12
See application file for complete search history.

(56) References Cited

U.S. PATENT DOCUMENTS 6,212,949 B1 4/2001 Inder et al.
6,270,726 B1 8/2001 Tyberg et al.

(Continued)

FOREIGN PATENT DOCUMENTS

DE 102006061222 7/2008
WO WO 2006/017737 2/2006

OTHER PUBLICATIONS

"Stat Fax 2600 Microplate Washer Owner's Manual", Sep. 1, 1999, XP55027303, www.mdairysolutions.com/Brochures/other_food/Abraxiskits/APlate_Washer_StatFax_2600_OM_Rev_1.2.pdf.

(Continued)

*Primary Examiner* — Alexander Markoff
(74) *Attorney, Agent, or Firm* — Notaro, Michalos & Zaccaria P.C.

(57) ABSTRACT

Setting method for microplate washing devices has a receptacle for receiving a microplate and a washing head having washing cannulas. The cannulas are in an array corresponding to a well array with lowermost ends define a work plane. This work plane is parallel to a reference plane. In a first phase, the receptacle and/or washing head are moved together until the lowermost ends of the cannulas touch a surface defining the reference plane. A sensor device has a controller linked thereto and from the sensor device is registered using the controller and a relative altitude value is determined therewith, which indicates touching of the surface by the lowermost ends of the cannulas or for determining the position of this surface. Based on this, an active altitude of the lowermost ends of the washing cannulas in relation to an inner surface of the well bottoms of a microplate is determined.

19 Claims, 3 Drawing Sheets

(56) References Cited

U.S. PATENT DOCUMENTS

| | | | | |
|---|---|---|---|---|
| 6,363,802 | B1 | 4/2002 | Grippo et al. | |
| 2004/0089330 | A1 | 5/2004 | Muller | |
| 2005/0013744 | A1* | 1/2005 | Nagai et al. | 422/100 |
| 2008/0101990 | A1* | 5/2008 | Liu et al. | 422/63 |

OTHER PUBLICATIONS

"Denville Atlantis Microplate Washer Users' manual", May 15, 2012, XP55027300, http://www.denvillescientific.com/docments/Denville_Atlantis_Users_Manual_vl.pdf.

* cited by examiner

SETTING METHOD FOR MICROPLATE WASHING DEVICES

RELATED PATENT APPLICATIONS

This patent application claims priority of the Swiss patent application No. CH 00135/11 and of the U.S. provisional application No. 61/436,684, both filed on Jan. 27, 2011. The entire disclosure of both of these priority defining applications is incorporated herein by explicit reference for any purpose.

RELATED TECHNICAL FIELD AND PRIOR ART

The invention relates to a setting method for microplate washing devices. Microplate washing devices have been known for some time and are used for the treatment of multiwell plates in which, for example, immune experiments (such as ELISA=enzyme linked immunosorbent assay) are performed. Such experiments comprise the delivery into and also the removal of liquid reagents from the wells of the microplates. Some components of these liquids form chemical bonds with the walls of the wells and/or with other components, therefore it is often necessary to remove the unbound components from the wells, i.e., to wash them out. This washing out is normally performed by means of washing cannulas, i.e., by introducing washing liquid into the wells via so-called dispenser cannulas and by suctioning the washing liquid out of the wells via so-called aspiration cannulas. Such microplate washing devices comprise at least one receptacle for receiving a microplate and a washing head having washing cannulas. A microplate comprises a well array (cf. standard microplates according to the norm ANSI_SBS 1-2004) and the washing cannulas of the washing head are arranged in an array corresponding to at least a part of the well array of this microplate. Because multiple wells are to be washed at the same time and preferably simultaneously, it is important that the lowermost ends of the washing cannulas define a work plane, which is very close to the bottoms of the microplate wells, without the washing cannulas of the washing head touching these bottoms of the microplate wells. In order that the washing cannulas can assume such a position in the wells, it has proven to be useful to arrange the work plane defined by the lowermost ends of the washing cannulas and a reference plane (for example, the inner surface of the well bottoms) parallel to one another.

The present invention presumes that this parallel arrangement of the work plane and the reference plane is already completed. This is also the case in already known methods, so that in a first phase in methods known from the prior art, the receptacle and the washing head are moved toward one another by moving the receptacle, the washing head or both, until the lowermost ends of the washing cannulas touch at least one surface defining the reference plane. A particular difficulty results during the visual monitoring of these movements if opaque microplates (e.g., black microplates for fluorescence measurements or white microplates for luminescence measurements) are used during this setting procedure in such a way that the washing cannulas are to touch the inner surfaces of the bottoms of the wells of this microplate. This first phase is quite tricky because of the restricted visual monitoring and is, in particular, dependent on the skill of the person who performs this setting.

For microplates which are well known and are frequently used, it has proven to be useful to apply a so-called plate library, in which all important parameters and geometric special features of already known microplates are stored. Thus, for example, in 24-well microplates, the axial spacing between two adjacent wells is 18 mm, in 96-well microplates it is 9 mm and in 384-well microplates it is 4.5 mm. The inner surfaces of the flat well bottoms of preferred microplates are each located above the footprint of these microplates by an amount which is referred to as the "well bottom elevation", as follows:

TABLE 1

| | |
|---|---|
| Greiner 96-well flat bottom = transparent microplate having 96 wells and flat bottom (Art. No. 655 101) = | 3.7 mm |
| 96 Greiner Micro-Assay-Plate = black microplate having transparent bottom (Art. No. 655 096) = | 3.5 mm |
| Greiner 384-well flat bottom = transparent microplate having 384 wells and flat bottom (Art. No. 781 101) = | 2.9 mm |
| 384 Greiner Micro-Assay-Plate = black microplate having transparent bottom (Art. No. 781 096) = | 2.9 mm. |

These data were taken from the Greiner Microplate Dimensions Guide (revised July 2007, 073 027) (cf. also www.gbo.com/bioscience).

Storing such plate library data in the software or firmware of microplate washing devices has proven to be particularly useful. However, if less common plate formats are used, the dimensions of which are not retrievable from the plate library, a visually monitored setting must be performed in the above-mentioned way, which is quite difficult and therefore also particularly time-consuming in particular in the case of opaque microplates.

OBJECT, SUMMARY, AND ADVANTAGES OF THE PRESENT INVENTION

It is therefore an object of the present invention to propose an alternative setting method for the use of arbitrary microplate formats and microplate types in microplate washing devices, which at least largely eliminates the disadvantages known from the prior art.

This object is achieved by the method defined in independent claim 1 in that a microplate washing device as described at the beginning is used, which additionally comprises a sensor device and a controller operationally linked to this sensor device. Thereby, a signal of this sensor device is registered using the controller and a relative altitude value is determined therewith. This signal indicates the touching of the surface by the lowermost ends of the washing cannulas or is usable for determining the position of this surface. Based on this relative altitude value, an active altitude of the lowermost ends of the washing cannulas in relation to inner surfaces of the well bottoms of a microplate during the operation of the microplate washing device is determined.

The surface defining the reference plane is preferably selected from the group which comprises inner surfaces of the bottoms of the wells of a microplate, a reference surface of a setting plate, a surface of an insert plate and a footprint of the receptacle for receiving a microplate. Preferred embodiments and further features according to the invention result from the dependent claims.

The method according to the invention comprises the following advantages in relation to the setting method known from the prior art for the use of arbitrary microplate formats in microplate washing devices:

The setting of the active altitude of the washing cannulas for working with opaque microplates can be performed automatically at the latest after the insertion of the microplate into the receptacle of the microplate washing device.

The setting of the active altitude of the washing cannulas for working with previously unknown, opaque microplates is performed more objectively and more reliably than manually with visual monitoring, because it is performed independently of the subjective perception of an operator.

The setting of the active altitude of the washing cannulas for working with previously unknown, opaque microplates requires less time in spite of increased reproducibility.

BRIEF INTRODUCTION OF THE ATTACHED DRAWINGS

The method according to the invention will be explained in greater detail on the basis of schematic drawings, which show exemplary embodiments and are not to restrict the scope of the invention. It is shown in:

FIG. 1 a schematic vertical section through a microplate washing device comprising a washing head and a microplate inserted into the corresponding receptacle;

FIG. 2 detail sections which represent the most essential altitude positions, wherein:

Figure 2A:
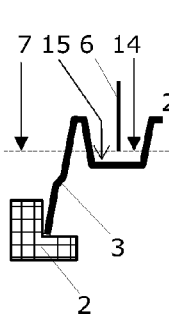
FIG. 2A shows a vertical section through the microplate receptacle comprising a microplate and a washing cannula in working position.
Figure 2B:
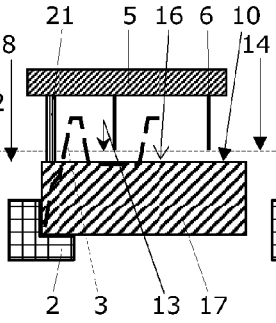
FIG. 2B shows a vertical section through a setting plate inserted into the microplate receptacle, wherein the surface of the setting plate simulates the inner surfaces of the bottoms of the microplate wells and wherein the sensor device comprises a feeler which protrudes by the working distance beyond the washing cannulas.
Figure 2C:
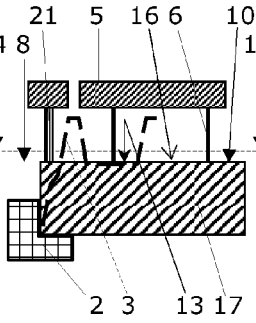
Figure 2D:
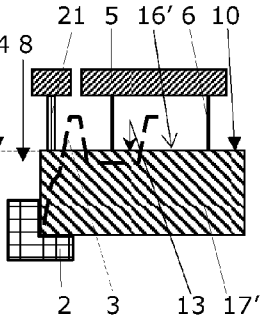
Figure 3A:
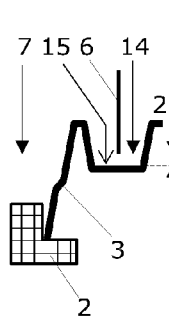
Figure 3B:
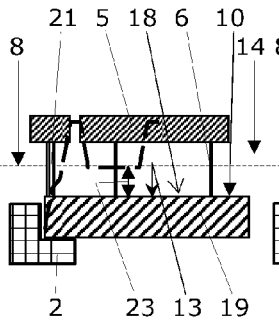
Figure 3C:
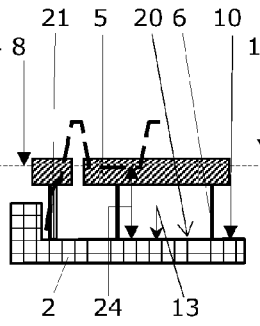
Figure 3D:
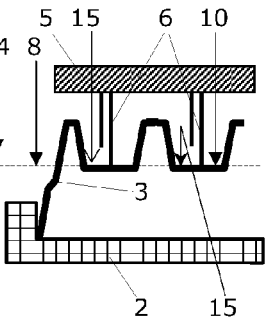
Figure 4:
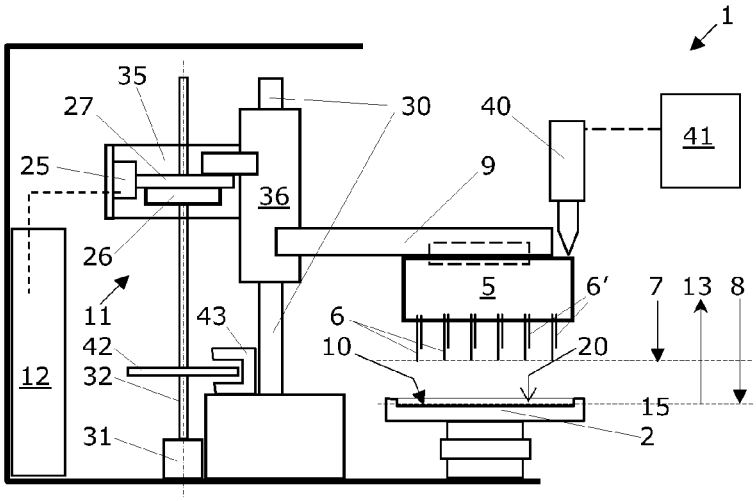
Figure 5:
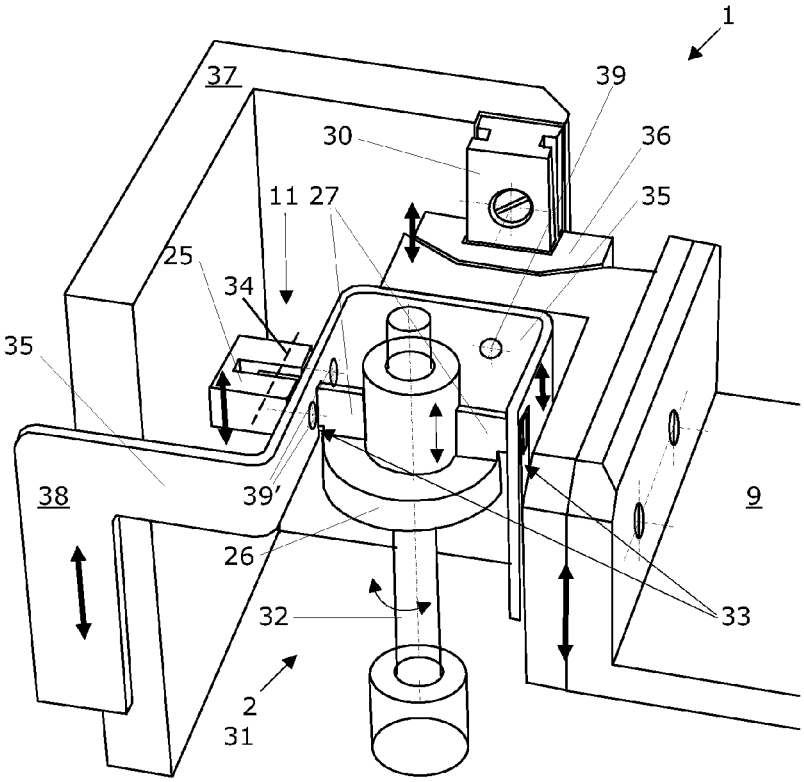
Figure 6:
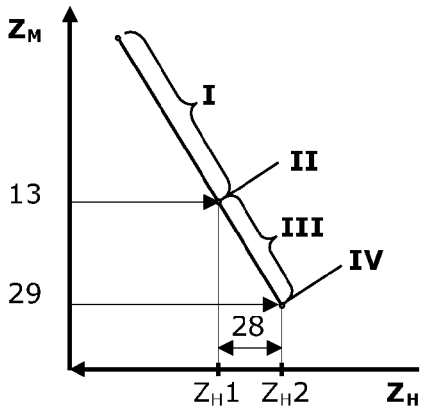
Figure 7:
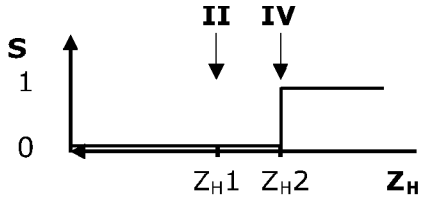
Figure 8:
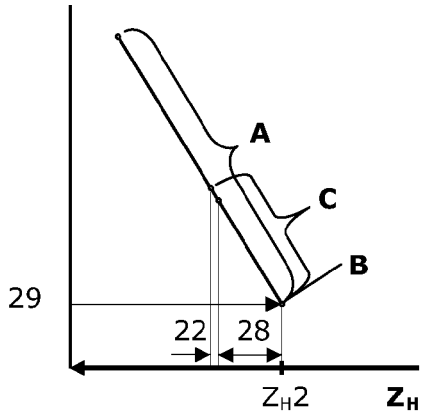
Figure 9:
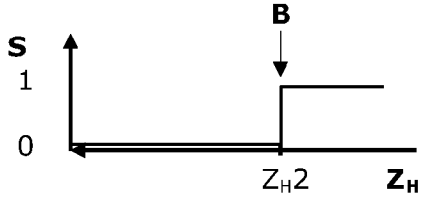

FIG. 2C shows a vertical section through a setting plate inserted into the microplate receptacle, wherein the surface of the setting plate simulates the inner surfaces of the bottoms of the microplate wells and wherein the sensor device can comprise a feeler, the frontmost end of which is in the work plane; and FIG. 2D shows a vertical section through a setting plate inserted into the microplate receptacle, wherein the surface of the setting plate simulates the work plane of the washing cannulas in the microplate wells and wherein the sensor device can comprise a feeler, the frontmost end of which is in the work plane;

FIG. 3 detail sections which represent the most essential altitude positions, wherein:

FIG. 3A shows a vertical section through the microplate receptacle comprising a microplate and a washing cannula in working position;

FIG. 3B shows a vertical section through an insert plate inserted into the microplate receptacle, wherein the sensor device can comprise a feeler, the frontmost end of which is in the work plane;

FIG. 3C shows a vertical section through the microplate receptacle, wherein the sensor device can comprise a feeler, the frontmost end of which is in the work plane; and FIG. 3D shows a vertical section through a microplate inserted into the microplate receptacle, wherein the surfaces of the well bottoms represent the surface defining the reference plane;

FIG. 4 a schematic vertical section through a microplate washing device comprising a washing head, but without inserted microplate;

FIG. 5 a 3-D representation corresponding to a part of FIG. 4, comprising a sensor device which comprises a light barrier;

FIG. 6 a path/path diagram for determining the predetermined correction amount, which must be taken into consideration when determining the active altitude of the lowermost ends of the washing cannulas according to the second embodiment of the setting method according to the invention (preferably by the manufacturer of the microplate washing device);

FIG. 7 a signal/path diagram during the determination of the predetermined correction amount in FIG. 6;

FIG. 8 a path diagram for determining the active altitude of the lowermost ends of the washing cannulas in relation to an inner surface of the well bottom of a microplate during operation of the microplate washing device (preferably by the user of the microplate washing device);

FIG. 9 a signal/path diagram during the determination of the active altitude in FIG. 8.

DETAILED DESCRIPTION OF THE PRESENT INVENTION

Figure 1:
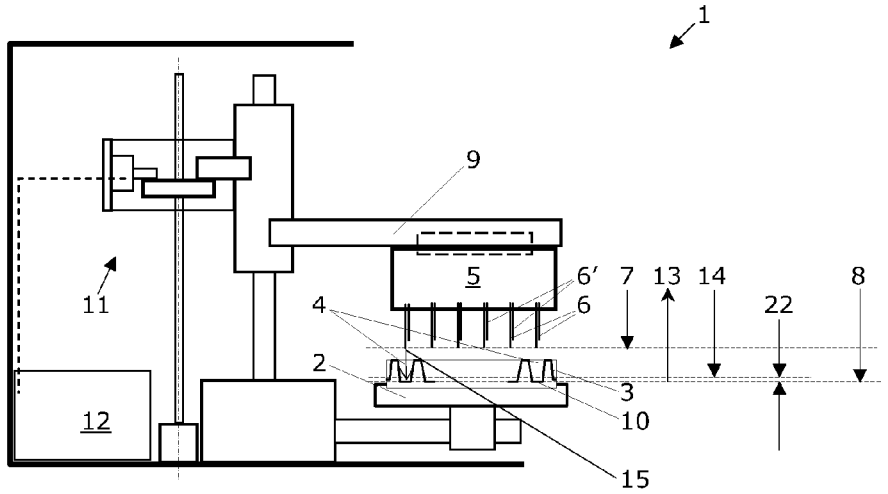

FIG. 1 shows a schematic vertical section through a microplate washing device 1 comprising a washing head 5 and a microplate 3 inserted into the corresponding receptacle 2. The well array 4 of the microplate is only indicated here. The washing head 5 is equipped with washing cannulas 6; these washing cannulas 6 are arranged in an array which corresponds to at least a part of the well array 4 of this microplate 3. Here, a linear array having six double cannulas is shown, which can be immersed in six adjoining wells of a microplate. The longer cannulas 6 are the aspiration cannulas for suctioning liquid out of the wells and the shorter cannulas 6' are the dispenser cannulas for introducing liquid into the wells.

The lowermost ends of the washing cannulas 6 define a work plane 7, which is oriented parallel to a reference plane 8 on this exemplary device. This parallel arrangement of the work plane 7 and the reference plane 8 is important, because in this way all washing cannulas 6 of a washing head 5 can be arranged to have their lowermost ends in an active altitude 14, at which they assume the same distance to the inner surfaces 15 of the bottoms of the wells of the microplate 3 used. The minimization of this distance between the aspiration cannulas and the well bottoms, the so-called working distance 22, allows the most comprehensive possible suctioning of liquid out of the wells, which is advantageous in particular when performing ELISA experiments (i.e., in so-called "enzyme-linked immunosorbent assays"). The working distance 22 is preferably 0.1 to 0.5 mm and particularly preferably 0.2 to 0.3 mm. If adherent cells or magnetic beads are to be used, a greater working distance 22 is normally selected, which is normally not as critical as in the case of ELISA experiments. If an experiment requires a specific working distance 22, the required value can be included in the software or firmware of the relevant microplate washing device 1; this working distance 22 is retrievable as needed during the operation of the microplate washing device 1.

In a first phase of the setting method for microplate washing devices, the receptacle 2 and/or a washing head 5, which is preferably fixed to a washing head carrier 9, are moved toward one another, until the lowermost ends of the washing cannulas 6 (here: the aspiration cannulas) touch at least one surface 10 defining the reference plane 8. Therefore, either the receptacle 2 is moved alone or the washing head 5 is moved alone or the receptacle 2 and the washing head 5 are moved together, such that a mutual approach occurs.

This surface 10 which defines the reference plane 8 can be provided by any stable plane which extends parallel to the lowermost ends of the washing cannulas 6 of a washing head 5 and also parallel to the inner surfaces 15 of the bottoms of the wells of the microplate 3 used. The surface 10 defining the reference plane 8 is preferably selected from the group which comprises inner surfaces 15 of the bottoms of the wells of a microplate 3, a reference surface 16 of a setting plate 17, a surface 18 of an insert plate 19 and a footprint 20 of the receptacle 2 for receiving a microplate 3. However, it is also possible to insert a microplate 3, which is closed on the bottom, and which is to be used in the microplate washing device 1, upside down into the receptacle 2, such that the bottom of the microplate, which is turned upward, forms the surface 10 defining the reference plane 8. Similarly, the surface of a microplate cover can be used as the surface 10 which defines the reference plane 8, wherein the microplate cover is laid on a microplate 3 inserted into the receptacle 2. The uppermost surface of a microplate 3 can also be used as the surface 10 defining the reference plane 8, wherein the microplate 3 is inserted into the receptacle 2.

For performing the method according to the invention, the microplate washing device 1 comprises a sensor device 11 and a controller 12 which is operationally linked to this sensor device. The sensor device 11 preferably comprises a touch sensor, which is selected from the group comprising electromechanical touch sensors and electrical contacts. Particularly preferably, the sensor device 11 comprises a contactless sensor which is selected from the group comprising capacitive proximity switches, Hall sensors and light barriers.

According to the invention, a signal of this sensor device 11 is registered using the controller 12 and a relative altitude value 13 is determined therewith. This sensor signal indicates the touching of the surface 10 (which defines the reference plane 8) by the lowermost ends of the washing cannulas 6. Alternatively thereto, this sensor signal is usable for determining the position of this surface 10 (which defines the reference plane 8).

In both cases, based on this relative altitude value 13, an active altitude 14 of the lowermost ends of the washing cannulas 6 in relation to inner surfaces 15 of the well bottoms of a microplate during the operation of the microplate washing device 1 is determined using the controller 12.

The method according to the invention is particularly well suitable for the determination of the active altitude 14 of the lowermost ends of the washing cannulas 6 for the operation of the microplate washing device in the case of microplates 3 comprising flat bottoms (cf., e.g., Table 1). With appropriate positioning of the washing cannulas 6 in relation to the respective microplate 3, however, the method according to the invention can also be used for microplates comprising a round or U-shaped bottom (e.g., Greiner Art. No. 650 207), microplates comprising a tapered or V-shaped bottom (e.g., Greiner Art. No. 651 209), or any other type of microplate.

The relative altitude value 13 (cf. FIG. 6) can be established by means of various methods. Preferably, a high-resolution measuring device for registering the position during linear displacements in relation to a known reference point is used for this purpose. A measuring sensor of the type HEIDENHAIN ST 1288 (DR. JOHANNES HEIDENHAIN GmbH, 83301 Traunreut, Germany) having a precision of +/−1 μm was used. The relative altitude value 13 is then calculated based on the traveled route in relation to the known level of the reference point; measurement is preferably performed directly at the washing head 5 or resp. at its rear side (cf. FIG. 4).

The altitude adjustment of the washing head 5 is preferably performed by means of a motor-driven drive spindle 32 (cf. FIGS. 4 and 5). The drive spindle 32 used is made of stainless steel 303 and has a diameter of 5.54 mm and a pitch of 4.86 mm. A stepping motor (type E43H4Q-05) from HAYDON (HAYDON KERK, Waterbury, Conn. 06705, USA) without a gearing is used for driving this drive spindle 32. In this linear motor, according to the datasheet, the motor axle and therefore also the drive spindle 32 rotate by an angle increment of 1.8° per full step. The drive spindle 32 is preferably an extension of the motor axle. Using the employed drive spindle 32, the motor 31 generates an altitude adjustment of the washing head 5 of 0.0243 mm (=24.3 μm) per full step or 4.86 mm per 200 full steps, i.e., per axle revolution. In the case of a preferred special control of the stepping motor (as is known per se to anyone skilled in the art and is supported in this case by the motor driver), the motor 31 is moved in quarter steps, such that one revolution of the motor axle and the drive spindle requires 800 quarter steps. The resolution thus achieved in the movement of the washing head 5 in the direction of the vertical Z axis is thus preferably 6.075 μm per individual quarter step.

According to a first embodiment of the setting method according to the invention, a washing head 5 is used, in which at least one of the washing cannulas 6 or a feeler 21 (which is additionally incorporated or mounted on) is formed to be at least partially electrically conductive. This at least one washing cannula 6 or this feeler 21 is electrically connected to the controller. The reference surface 16 of the setting plate 17, the surface 18 of an insert plate 19 or the footprint 20 of the receptacle 2 for receiving a microplate 3 are also formed to be at least partially electrically conductive and are electrically connected to the controller 12. The controller applies an electrical voltage via the two connections to the at least one washing cannula 6 resp. this feeler 21 and to the surface 10 which defines the reference plane 8. If the surface 10 (i.e., the reference surface 16, the surface 18, or the footprint 20) defining the reference plane 8 is touched by the lowermost end of the at least one washing cannula 6 or of the feeler 21, an electrical contact is produced and the circuit is closed; this signal is detected by the controller 12.

FIG. 2 shows detail sections which illustrate the most essential altitude positions. FIG. 2A shows a vertical section through the microplate receptacle 2 having an inserted microplate 3 and a washing cannula 6 in the working position. The working distance 22, which is 0.2 mm in this especially preferred case, is shown such that it is well visible here (but not to scale). So, the active altitude 14 of the lowermost ends of the washing cannulas 6 during operation of the microplate washing device 1 comprising an inserted microplate is shown. The most uniform possible setting of this active altitude 14 for the lowermost ends of all washing cannulas 6 of a washing head 5 is the goal of the present method according to the invention.

FIG. 2B shows a vertical section through a setting plate 17 inserted into the microplate receptacle 2. The surface of the setting plate 17 is implemented as a reference surface 16 and corresponds here in particular to the inner surfaces 15 of the bottoms of the microplate wells (cf. FIG. 2A). In this case, the washing head 5 comprises an electrically conductive feeler 21 of the sensor device 12, wherein the frontmost end of the feeler 21 protrudes beyond the lowermost ends of the washing cannulas 6 by the working distance 22. The feeler 21 therefore protrudes beyond the washing cannulas 6 by an amount which corresponds to the working distance 22 of the lowermost ends of the washing cannulas 6 in the operation of the microplate washing device 1.

FIG. 2C shows a vertical section through a setting plate 17 inserted into the microplate receptacle 2. The surface of the setting plate 17 is implemented as a reference surface 16 and corresponds here in particular to the inner surfaces 15 of the bottoms of the microplate wells (cf. FIG. 2A). In this case, the washing head 5 can comprise an electrically conductive feeler 21 of the sensor device 12, wherein the frontmost end of the feeler 21 is located in the work plane 7 of the washing cannulas 6. The washing head 5 is shown interrupted here, this indicates the optional use of the electrically conductive feeler 21; if at least one of the washing cannulas 6 is formed to be at least partially electrically conductive, this feeler 21 can be omitted.

FIG. 2D shows a vertical section through a special setting plate 17' inserted into the microplate receptacle 2. The surface of this setting plate 17' simulates the work plane 7 (i.e., the active altitude 14) of the washing cannulas 6 in the microplate wells. Also in this case, the washing head 5 can comprise an electrically conductive feeler 21 of the sensor device 12, wherein the frontmost end of the feeler 21 is located in the work plane 7 of the washing cannulas 6. The washing head 5 is shown interrupted here, this indicates the optional use of the electrically conductive feeler 21; if at least one of the washing cannulas 6 is formed to be at least partially electrically conductive, this feeler 21 can be omitted.

According to a first variant of the first embodiment of the method according to the invention, the reference surface 16' of the setting plate 17' is the surface 10 defining the reference plane 8 (cf. FIG. 2D). In this case, the washing head 5 can comprise an electrically conductive feeler 21 of the sensor device 12, wherein the frontmost end of the feeler 21 is preferably located in the work plane 7 of the washing cannulas 6. Here, the reference plane 8 corresponds to the active altitude 14. The controller 12 therefore sets the active altitude 14 of the lowermost ends of the washing cannulas 6 to be determined for the operation of the microplate washing device 1 to be equal to the relative altitude value 13 of the lowermost ends of the washing cannulas 6 or the feeler 21 upon touching the surface 10 defining the reference plane 8.

According to a second variant of the first embodiment of the method according to the invention, the reference surface 16 of the setting plate 17 is the surface 10 defining the reference plane 8 (cf. FIG. 2C). Also in this case, the washing head 5 can comprise an electrically conductive feeler 21 of the sensor device 12, wherein the frontmost end of the feeler 21 is preferably located in the work plane 7 of the washing cannula 6. The reference plane 8 does not correspond to the active altitude 14 here. The controller 12 therefore determines the active altitude 14 of the lowermost ends of the washing cannulas 6 for the operation of the microplate washing device 1 in that a working distance 22 is calculated using the relative altitude value 13 of the lowermost ends of the washing cannulas 6 or the feeler 21 upon touching the surface 10 defining the reference plane 8.

According to a third variant of the first embodiment of the method according to the invention, the reference surface 16 of the setting plate 17 is the surface 10 defining the reference plane 8 (cf. FIG. 2B). In this case, the washing head 5 comprises an electrically conductive feeler 21 of the sensor device 12, wherein the frontmost end of the feeler 21 is located by the working distance 22 below the work plane 7 of the washing cannulas 6. The reference plane 8 corresponds here to the inner surfaces 15 of the bottoms of the microplate wells. The controller 12 therefore determines the active altitude 14 of the lowermost ends of the washing cannulas 6 for the operation of the microplate washing device 1 in that the relative altitude value 13 of the frontmost end of the feeler 21 upon touching the surface 10 defining the reference plane 8 is set equal to the active altitude 14 of the lowermost ends of the washing cannulas 6 for the operation of the microplate washing device 1.

FIG. 3 shows detail sections which illustrate the most essential altitude positions. FIG. 3A shows a vertical section through the microplate receptacle 2 comprising a microplate 3 put thereon and a washing cannula 6 in the working position. The working distance 22, which is 0.15 mm in this specially preferred case, is shown such that it is well visible here (but also not to scale). Here thus, the active altitude 14 of the lowermost ends of the washing cannulas 6 during operation of the microplate washing device 1 comprising an inserted microplate is shown. The most uniform possible setting of this active altitude 14 for the lowermost ends of all washing cannulas 6 of a washing head 5 is the goal of the present method according to the invention.

FIG. 3B shows a vertical section through an insert plate 19 inserted into the microplate receptacle 2. The surface 18 of the insert plate 19 is implemented as a reference surface 16 and does not correspond to the inner surfaces 15 of the bottoms of the microplate wells (cf. FIG. 3A). This surface 18 can define an altitude level which corresponds to another altitude uniquely defined by the microplate 3. However, it is also conceivable that this surface 18 of the insert plate 19 defines an altitude level which does not correspond to any altitude uniquely defined by the microplate 3. In this case, the washing head 5 can comprise an electrically conductive feeler 21 of the sensor device 12, wherein the frontmost end of the feeler 21 is located in the work plane 7 of the washing cannulas 6. Here, the washing head 5 is shown interrupted, this indicates the optional use of the electrically conductive feeler 21; if at least one of the washing cannulas 6 is formed to be at least partially electrically conductive, this feeler 21 can be omitted.

FIG. 3C shows a vertical section through the microplate receptacle 2. Here, the footprint 20 of the receptacle 2 for a microplate 3 is the surface 10 defining the reference plane 8. Also in this case, the washing head 5 can comprise an electrically conductive feeler 21 of the sensor device 12, wherein the frontmost end of the feeler 21 is located in the work plane 7 of the washing cannulas 6. The washing head 5 is shown interrupted here, this indicates the optional use of the electrically conductive feeler 21; if at least one of the washing cannulas 6 is formed to be at least partially electrically conductive, this feeler 21 can be omitted.

FIG. 3D shows a vertical section through a microplate 3 inserted into the microplate receptacle 2. Here, the inner surfaces 15 of the well bottoms represent the surface 10 defining the reference plane 8. In this case, the washing head 5 does not comprise an electrically conductive feeler 21 of the sensor device 12. Rather, the sensor device 12 comprises a contactless sensor, which is incorporated in the microplate washing device 1 (cf. FIG. 4).

According to a fourth variant of the first embodiment of the method according to the invention, the surface 18 of the insert plate 19 is the surface 10 defining the reference plane 8 (cf. FIG. 3B). In this case, the washing head 5 can comprise an electrically conductive feeler 21 of the sensor device 12, wherein the frontmost end of the feeler 21 is preferably located in the work plane 7 of the washing cannulas 6. The reference plane 8 does not correspond to the active altitude 14 here. The controller 12 therefore determines the active altitude 14 of the lowermost ends of the washing cannulas 6 for the operation of the microplate washing device 1 in that a vertical dimension 23 typical for microplates and a working distance 22 are calculated using the relative altitude value 13 of the lowermost ends of the washing cannulas 6 or the feeler 21 upon touching the surface 10 defining the reference plane 8.

According to a fifth variant of the first embodiment of the method according to the invention, the footprint 20 of the receptacle 2 for receiving a microplate 3 is the surface 10 defining the reference plane 8 (cf. FIG. 3C). In this case, the washing head 5 can comprise an electrically conductive feeler 21 of the sensor device 12, wherein the frontmost end of the feeler 21 is preferably located in the work plane 7 of the washing cannulas 6. The reference plane 8 does not correspond to the active altitude 14 here. The controller 12 therefore determines the active altitude 14 of the lowermost ends of the washing cannulas 6 for the operation of the microplate washing device 1 in that a vertical dimension 24 representing microplates and a working distance 22 are calculated using the relative altitude value 13 of the lowermost ends of the washing cannulas 6 or the feeler 21 upon touching the surface 10 defining the reference plane 8.

Notwithstanding FIGS. 2B, 2C, and 2D, as well as 3B and 3C, in which the level of the lower end of the feeler 21 differs at most by the working distance 22 from the level of the lower ends of the washing cannulas 5, this level difference can also be significantly greater. In addition, the lower end of the feeler 21 can be located above the level of the lower ends of the washing cannulas 6. A setting plate 17 can thus be inserted into the receptacle 2, which plate has a protrusion intended for the feeler, which protrusion would even protrude beyond an inserted microplate. Such a protrusion (which can also be located on the edge of the microplate receptacle 2) is particularly reliably detected by the feeler 21 and prevents the feeler 21 and an inserted microplate 3 from possibly mutually touching or even damaging.

FIG. 4 shows a schematic vertical section through a microplate washing device 1 comprising a washing head 5 (which has six washing cannula pairs here, i.e., six aspiration cannulas 6 and six dispenser cannulas 6'), but without a microplate 3 inserted into the receptacle 2 provided for this purpose. Here, the washing cannulas 6, 6' of the washing head 5 are arranged in a linear array, which corresponds to at least a part of the well array of this microplate 3. Eight aspiration cannulas 6 and eight dispenser cannulas 6' are preferably used, so that precisely one column of a 96-well microplate can be processed simultaneously; for this purpose, one longer aspiration cannula 6 and one shorter dispenser cannula 6' are lowered into each one of the eight wells of a column of a 96-well microplate. The washing head can also be equipped with a nonlinear array of washing cannulas, e.g., with a 4×4 array, a 2×8 array or an 8×12 array, the latter corresponding to a so-called 96-space washing head. Larger arrays of 12×16 (192-space washing head) or 16×24 (384-space washing head) washing cannulas or washing cannula pairs are also conceivable.

Beside the already described, strip-shaped washing heads comprising an essentially linear arrangement of 8 washing cannula pairs, washing heads of microplate washing devices comprising an essentially linear arrangement of, for example, 12, 16, or 24 washing cannula pairs can also be set using the method according to the invention. Such washing heads are suitable, for example, for washing:

- an entire row of 12 wells in 96-well microplates rotated by 90°,
- an entire column of 16 wells in 384-well microplates, or
- an entire row of 24 wells in 384-well microplates rotated by 90°.

Here, the measuring sensor 40 is attached to the top side of the washing head 5, such that the effective movement of the washing head 5 is measured and can be read out on a separate display 41 and/or stored in the controller 12 of the microplate washing device 1.

Here, the washing head 5 is shown as vertically adjustable, but it can also be formed to be fixed in the washing operation of the device. In any case, the washing head 5 is sufficiently vertically movable during the performing of the setting method according to a second embodiment of the setting method according to the invention, such that the setting method according to the second embodiment described hereafter can be executed. The microplate receptacle 2 can be formed to be fixed or adjustable in altitude. Each altitude adjustment of the washing head 5 and/or of the microplate receptacle 2 is preferably performed in the vertical Z direction of a Cartesian coordinate system. In addition, it can be provided that the microplate receptacle 2 is moved in the horizontal X direction of this Cartesian coordinate system, as is known from the microplate washing device, for example, which the present applicant offers under the trade name Power Washer 384™. In any case, the microplate washing device 1 is implemented such that the receptacle 2 comprising the microplate 3 and a washing head 5 can be moved toward one another in such a manner that the washing cannulas 6, 6' can be placed in the wells of this microplate 3.

In addition, it is important that a work plane 7 defined by the lowermost ends of the washing cannulas 6 and a reference plane 8 are arranged parallel to one another. If these two planes 7, 8 were not parallel to one another, the washing cannulas 6 of a linear array (i.e., in a strip arrangement) could still be arranged at the same height if the tilt axis of one of the two planes 7, 8 extended parallel to the lowermost ends of the washing cannulas 6. However, if a nonlinear (or two-dimensional) array of 8×12 washing cannulas 6 or washing cannula pairs were used, for example, all washing cannulas 6 could not be arranged at the same working distance 22 to the inner surfaces 15 of the well bottoms of a microplate 3.

Because it is essential for a reproducible performing of delicate experiments that the geometrical conditions are as identical as possible in all involved wells of a microplate, a uniform working distance 22 of all aspiration cannulas 6 from the inner surfaces 15 of the well bottoms of a microplate 3 is desirable.

Starting from the parallel arrangement of the work plate 7 and the reference plane 8, in a first phase of the setting method according to the invention, the receptacle 2 and/or a washing head 5, which is preferably fastened on a washing head carrier 9, are moved toward one another, until the lowermost ends of the washing cannulas 6 touch at least one surface 10 defining the reference plane 8.

In FIG. 4, a light barrier 25 (OPTEK, Type OPB460N11; OPTEK Technology Inc., Carrollton, Tex. 75006, USA) which is rigidly connected to the washing head 5 is shown. This light barrier 25 is part of the sensor device 11 and serves to register the touching of a surface 10 defining the reference plane 8. For performing the method according to the invention, the microplate washing device 1 comprises a sensor device 11 and a controller 12 operationally linked to this sensor device. A signal of this sensor device 11 is registered using the controller 12, which signal indicates the touching of the surface 10 by the lowermost ends of the washing cannulas 6 (cf. the above-described first embodiment of the method according to the invention) or is usable for the determination thereof (cf. the second embodiment of the method according to the invention described in the following).

In both embodiments of the method according to the invention, an active altitude 14 of the lowermost ends of the washing cannulas 6 in relation to an inner surface 15 of the well bottoms of a microplate during the operation of the microplate washing device 1 is determined based on the relative altitude value 13 using the controller 12.

FIG. 5 shows a 3-D illustration corresponding to a part of FIG. 4, comprising a sensor device 11 which comprises a light barrier 25. A linear guide 30, which preferably extends precisely in the Z direction of a Cartesian coordinate system, is fixed on a support device 37 of the microplate washing device 1. A linear guide of the type MN12 from SCHNEEBERGER (SCHNEEBERGER Holding AG, 4914 Roggwil, Switzerland) was used. At least one connecting part 36, on which the washing head carrier 9 is rigidly fixed, is arranged movably along this linear guide 30. The washing head 5 is not shown here, only a part of the washing head carrier 9 employed here is visible. The double arrows indicate the parts, which are movable in altitude.

A lifting bracket 35 is fastened on a connecting part 36 and therefore rigidly connected to the washing head carrier 9. This connection between the connecting part 36 and the lifting bracket 35 is preferably established by means of two screws 39, only one of the screws 39 being visible in FIG. 5. The lifting bracket 35 has at least one slot 33, but preferably two slots 33, each having one end stop. The motor 31 drives a drive spindle 32, which in turn acts on a lifting flange 26, which is guided non-rotatably, such that during the rotation of the drive spindle 32, the lifting flange 26 is lowered or raised depending on the selected rotational direction. At least one, but preferably two bars 27, which support the washing head carrier 9 via the lifting bracket 35, are fixed to the lifting flange 26. As shown, these two bars 27 are movable in the slots 33 of the lifting bracket 35 in the Z direction. The two bars 27 and the two slots 33 are preferably adapted to one another so that during the raising of the bars 27 using the lifting flange 26, both bars 27 are simultaneously applied to the respective end stops of the slots 33. Therefore, the washing head carrier 9 is raised as soon as the two bars 27 are applied to the respective end stops of the slots 33 and the lifting flange 26 is moved upward in the Z direction.

The behavior is different if the washing head carrier 9 stops at an obstacle during the downward movement of the lifting flange 26, for example, because the lowermost ends of the washing cannulas 6 are standing on a surface 10 defining the reference plane 8. In this case, only the lifting flange 26 still moves downward: The two bars 27 separate from the respective end stops of the slots 33 and move downward, together with the lifting flange 26. However, because the light barrier 25 is permanently fixed to the lifting bar 36 (for example, using two screws 39', cf. FIG. 5), and because the lifting bracket is rigidly connected to the washing head carrier 9 (for example, using two screws 39, cf. FIG. 5), the light barrier 25 remains stationary, together with the lifting bracket 36 and the washing head carrier 9. During this movement downward solely of the bars 27, the bar 27, which had previously interrupted the light beam 34, is also moved out of the light barrier 25. As soon as this bar 27 releases the light beam 34 (i.e., no longer interrupts it), a corresponding signal of the light barrier 25 is registered and processed by the controller 12.

Because the geometry of the drive spindle 32 and the transmission ratio of an optionally used gearing (not shown) are known and because the number of angle increments of the motor 31 is continuously recorded by the controller, a correction amount 28 may be determined, which corresponds to the difference in altitude which the bar 27 must travel between the detachment from the end stop of "its" slot 33 and the release of the light beam 34 of the light barrier 25. This correction amount 28 is typical for each device and unchangeable, it can be established once by the manufacturer of a specific microplate washing device 1 (cf. FIG. 6) and then stored as a known parameter in the firmware of this specific microplate washing device 1.

The lifting bracket 35 preferably comprises a tab 38 connected permanently thereto. All electrical lines between the light barrier 25 and the controller 12 can be fixed to this tab 38.

FIG. 6 shows a path/path diagram for determining the predetermined correction amount 28, which must be considered when determining the active altitude 14 of the lowermost ends of the washing cannulas 6 according to the second embodiment of the setting method according to the invention. In FIG. 6, the effective movement ($Z_H$) of the lifting flange 26 in the direction of the Z axis is plotted on the first axis and the external movement ($Z_M$) of the washing head 5 of the microplate washing device 1 (measured using e.g. the HEIDENHAIN measuring touch sensor) is plotted on the second axis. The correction amount 28 is essentially determined by the geometry of the light barrier 25 and the bar 27 engaging in this light barrier 25. This correction amount 28 is determined by the manufacturer of the microplate washing device 1 in a standard way as follows:

I. The lifting flange 26 of the microplate washing device 1 and the washing head 5 are lowered together until the washing head 5 stops at point II and does not lower further. This lowering is carried out by means of the motor 31 and the drive spindle 32. During the lowering, the HEIDENHAIN measuring touch sensor follows this movement of the washing head 5.

II. The point II is determined using the HEIDENHAIN measuring touch sensor. The point II corresponds to the relative altitude value 13 used in the method according to the invention, which itself corresponds to the altitude value $Z_H$1 of the lifting flange 26.

III. The lifting flange 26 of the microplate washing device 1 is lowered further alone until the light barrier 25 communicates at point IV that the light beam is no longer interrupted by the bar 27. This lowering is preferably performed e.g. in quarter steps of the stepping motor 31, each quarter step of the stepping motor corresponding to the lowering of the lifting flange 26 e.g. by 6.075 μm.

IV. The number of the quarter steps of the stepping motor 31 which are required to lower the lifting flange 26 from point II to point IV is registered and multiplied by 6.075 μm, whereby the altitude value $Z_H$2 of the lifting flange 26 is obtained.

V. The difference of the two altitude values $Z_H$1 and $Z_H$2 of the lifting flange 26 corresponds to the desired correction amount 28, which is thus predetermined for this microplate washing device 1.

VI. The correction amount 28 which is individually predetermined for each microplate washing device 1 is recorded in the firmware of the relevant microplate washing device 1 and is retrievable as needed in the operation of the microplate washing device 1.

FIG. 7 shows a signal/path diagram during the determination of the predetermined correction amount 28 in FIG. 6. In FIG. 7, the effective movement ($Z_H$) of the lifting flange 26 of the microplate washing device 1 in the direction of the Z axis is plotted on the first axis and the signal of the light barrier 25 is plotted on the second axis. The diagram shows that the signal of the light barrier 25 changes from 0 to 1 at the altitude value $Z_H$2 of the lifting flange 26. This occurs in phase III of the standard method for determining the correction amount 28 executed by the manufacturer of the microplate washing device 1.

FIG. 8 shows a path diagram for determining the active altitude 14 of the lowermost ends of the washing cannulas 6 in relation to an inner surface 15 of the well bottoms of a microplate 3 during the operation of the microplate washing device 1. This method is executed by the user who works with the microplate washing device 1. Thereby, the user proceeds as follows:

A. The lifting flange 26 of the microplate washing device 1 and the washing head 5 are (at least partially) jointly lowered, until the light barrier 25 reports at point B that the light beam is no longer interrupted by the bar 27. This lowering is preferably performed e.g. in quarter steps of the stepping motor 31, wherein each quarter step of the stepping motor corresponds corresponding to lowering the lifting flange 26 e.g. by 6.075 μm B. At point B, which corresponds to the altitude value $Z_H$2 of the lifting flange 26, the downward movement of the lifting flange 26 is stopped.

C. The lifting flange 26 of the microplate washing device 1 and the washing head 5 are (at least partially) jointly raised by a value which is composed of the predetermined correction amount 28 and the required working distance 22. This raising is preferably performed e.g. in quarter steps of the stepping motor 31, wherein each quarter step of the stepping motor corresponds to raising the lifting flange 26 e.g. by 6.075 μm.

This determination of the active altitude 14 of the lowermost ends of the washing cannulas 6 in relation to an inner surface 15 of the well bottom of a microplate 3 is preferably performed automatically during operation of the microplate washing device 1, so that the user must merely trigger the procedure. This triggering is preferably performed by activating a switch intended for this purpose. This switch is implemented, for example, as a virtual switch (e.g., on a PC monitor or a graphic user interface [GUI]), as a key on a PC keyboard or as an electrical button or switch.

FIG. 9 shows a signal/path diagram during the determination of the active altitude 14 of the lowermost ends of the washing cannulas 6 in FIG. 8. In FIG. 9, the effective movement ($Z_H$) of the lifting flange 26 of the microplate washing device 1 in the direction of the Z axis is plotted on the first axis and the signal of the light barrier 25 is plotted on the second axis. The graph shows that the signal of the light barrier 25 changes from 0 to 1 at the altitude value $Z_H$2 (corresponding to the point B in FIG. 8) of the lifting flange 26. This occurs at the end of the phase A of the standard method, executed by the user of the microplate washing device 1, for determining the active altitude 14 of the lowermost ends of the washing cannulas 6 in relation to the inner surface 15 of the well bottoms of an employed microplate.

It is advantageous to let the user of the microplate washing device determine the time of this setting himself, because the user must first insert a microplate 3 intended for use into the receptacle 2 of the microplate washing device 1. This is primarily the case, if the microplate washing device 1 must be set to a microplate 3 which has never been used previously. Preferably, after the completed setting method on the microplate washing device 1, the currently set distance between the lowermost ends of the washing cannulas 6 (i.e., the work plane 7) and the footprint 20 of the microplate 3 (i.e., the surface of the microplate receptacle 2) is displayed in millimeters.

The user can preferably store the determined value, which is composed of the predetermined correction amount 28 and the required working distance 22, together with the microplate type used to determine this value, in the plate library of the microplate washing device 1.

If this microplate 3 is a microplate which has already been processed earlier using the present microplate washing device 1, the user can omit the setting method and retrieve the required value, which is composed of the predetermined correction amount 28 and the required working distance 22, together with the corresponding microplate type from the plate library.

However, the motor 31 can also be used as a DC motor for driving the drive spindle 32. In this case, the DC motor is equipped with a decoder (for example, with a slotted disk 42 and a light barrier 43), which detects angle increments, so that similarly as in the case of the stepping motor—the drive spindle 32 can be moved in angle increments or its movement can at least be registered in angle increments. On the one hand, the transmission ratio of the motor used and, on the other hand, the pitch of the drive spindle 32 are important for the precise movement of the washing head 5. It is also preferable here that the drive spindle 32 is an extension of the motor axle. In particular, the reproducibility of the movements of the washing head 5 is also to be ensured.

According to the second embodiment of the method according to the invention, a microplate washing device 1 is used (by the manufacturer or by the user), which comprises a light barrier 25, which is rigidly connected to the washing head 5 (cf. FIGS. 4 and 5). In addition, the microplate washing device 1 comprises a lifting flange 26, which is rigidly connected to a bar 27 supporting the washing head carrier 9.

During a second phase (cf. III in FIG. 6) following the first phase (cf. I in FIG. 6) of the setting method according to the invention, the light barrier 25 and the bar 27 are moved away from one another (preferably by the manufacturer), until a light beam 34 of the light barrier 25, which is interrupted during the first phase by the bar 27, is no longer interrupted.

During a first phase (cf. A in FIG. 8) of the setting method according to the invention, the light barrier 25 and the bar 27 are moved away from one another (preferably by the user), until a light beam 34 of the light barrier 25, which is interrupted by the bar 27, is no longer interrupted.

Furthermore, in the course of the setting method according to the invention using the controller 12, the relative altitude value 13 of the lowermost ends of the washing cannulas 6 upon touching the reference plane 8 can be determined (preferably by the manufacturer of the microplate washing device) in that the constant path which the lifting flange 26, together with the bar 27, travels during the second phase (cf. III in FIG. 6) is determined as a predetermined correction amount 28 and calculated using a altitude position 29 of the lifting flange 28 determined at the end of the second phase.

For performing the setting method according to the invention, the inner surfaces 15 of the bottoms of the wells of a microplate 3 preferably serve as the surfaces 10 defining the reference plane 8 (cf. FIG. 3D). In this case, the washing head 5 does not comprise an electrically conductive feeler 21 of the sensor device 12. Furthermore, the reference plane 8 does not correspond to the active altitude 14 of the lowermost ends of the washing cannulas 6 here. The controller 12 therefore determines the active altitude 14 of the lowermost ends of the washing cannulas 6 for the operation of the microplate washing device 1 in that a working distance 22 is calculated using the relative altitude value 13 of the lowermost ends of the washing cannulas 6 upon touching the surface 10 defining the reference plane 8. In this case, however, it is not merely the touching which serves to determine the relative altitude value 13; in addition, the procedure for determining the correction amount 28 which was already described in connection with FIG. 6 must also be taken into consideration. Accordingly, to ascertain the active altitude 14 of the lowermost ends of the washing cannulas 6 according to the second embodiment of the setting method according to the invention, the predetermined correction amount 28 and the working distance 22 are taken into consideration.

The controller 12 finally determines the active altitude 14 of the lowermost ends of the washing cannulas 6 for the operation of the microplate washing device 1 in that a predetermined correction amount 28 and a working distance 22 are calculated using the altitude position 29 of the lifting flange 26 determined at the end of the second phase.

A method according to the invention applies to the use of a microplate washing device 1 and relates to the setting thereof. A microplate washing device 1 is used, which at least comprises the following:

- a receptacle 2 for receiving a microplate 3, wherein the microplate 3 comprises a well array 4;
- a washing head 5 comprising washing cannulas 6, wherein the washing cannulas 6 are arranged in an array corresponding to at least a part of the well array 4 of this microplate 3 and define a work plane 7 with their lowermost ends; and
- a sensor device 11 and a controller 12 operationally linked to this sensor device, which processes the signals of this sensor device 11 and controls the movements of the receptacle 2 and/or the washing head 5.

Thereby, it is presumed that the work plane 7 defined by the lowermost ends of the washing cannulas 6 and a reference plane 8 are arranged parallel to one another.

The method of using this microplate washing device 1 according to the invention is characterized in that:

(a) the receptacle 2 and the washing head 5 are moved toward one another, by moving the receptacle 2, the washing head 5, or both, until the lowermost ends of the washing cannulas 6 touch inner surfaces 15 of the well bottoms of a microplate 3 present in the receptacle 2;

(b) this touching of the inner surfaces 15 of the well bottoms by the lowermost ends of the washing cannulas 6 is registered by the sensor device 11 and the controller 12; and (c) the controller causes the microplate washing device to move the receptacle 2 and/or the washing head 5 such that the lowermost ends of the washing cannulas 6 are moved to an active altitude 14 in relation to the inner surface 15 of the well bottoms of the microplate 3.

A method of using the microplate washing device is particularly preferred, in which, in their active altitude 14 determined in step (c), the lowermost ends of the washing cannulas 6 are spaced by a working distance 22 from the inner surfaces 15 of the well bottoms of the microplate 3 used in step (a) during operation of the microplate washing device 1, wherein the working distance 22 is established and input by a user or wherein a stored value for the working distance 22 is retrieved by the controller 12 and is automatically included during the determination of the active altitude 14.

Although not all reference signs in the figures have been mentioned in each case, they always refer to the same technical features.

| List of reference signs | |
|---|---|
| 1 | microplate washing device |
| 2 | receptacle |
| 3 | microplate |
| 4 | well array |
| 5 | washing head |
| 6, 6' | washing cannula(s) |
| 6 | aspiration cannula |
| 6' | dispenser cannula |
| 7 | work plane |
| 8 | reference plane |
| 9 | washing head carrier |
| 10 | surface defining reference plane |
| 11 | sensor device |
| 12 | controller |
| 13 | relative altitude value |
| 14 | active altitude |

-continued

| List of reference signs | |
|---|---|
| 15 | inner surface(s) of the bottom of the wells of the microplate |
| 16, 16' | reference surface of 17, 17' |
| 17, 17' | setting plate |
| 18 | surface of 19 |
| 19 | insert plate |
| 20 | footprint of 2 |
| 21 | feeler |
| 22 | working distance |
| 23 | vertical dimension typical for microplates |
| 24 | vertical dimension representing microplate |
| 25 | light barrier |
| 26 | lifting flange |
| 27 | bar supporting the washing head carrier |
| 28 | predetermined correction amount |
| 29 | determined altitude position of 26 |
| 30 | linear guide |
| 31 | motor |
| 32 | drive spindle |
| 33 | slot |
| 34 | light beam of 25 |
| 35 | lifting bracket |
| 36 | connecting part |
| 37 | support device |
| 38 | tab |
| 39 | screws |
| 40 | measurement sensor |
| 41 | display of 40 |
| 42 | slotted disk |
| 43 | light barrier |

What is claimed is:

1. A method for setting a microplate washing device (1):

the method comprising providing a microplate washing device (1) and a microplate (3), the microplate washing device (1) comprising:

a receptacle (2) for receiving the microplate (3), the microplate (3) comprising a well array (4) with well bottoms;

a washing head (5) having washing cannulas (6), the washing cannulas (6) being arranged in an array corresponding to at least a part of the well array (4) of the microplate (3), the washing cannulas (6) having lowermost ends collectively defining a work plane (7);

a sensor device (11) comprising a light barrier (25);

a washing head carrier (9), the washing head carrier (9) being fixed to both the washing head (5) and to the light barrier (25);

a controller (12) operationally linked to the sensor device (11), which controller (12) processes signals of the sensor device (11) and controls movements of the receptacle (2) and/or of the washing head (5) of the microplate washing device (1); and a bar (27) fixed to a lifting flange (26), wherein the bar (27) is positioned for supporting the washing head carrier (9) from below but is not fixed to the washing head carrier (9) and is capable of disengaging from the washing head carrier (9);

wherein the work plane (7), which is defined by the lowermost ends of the washing cannulas (6), and a reference plane (8), which is defined by inner surfaces (15) of the well bottoms of the microplate (3), are arranged parallel to one another, and wherein the setting method comprises the following steps:

(a) with the light barrier (25) interrupted by the bar (27): the receptacle (2) and the washing head (5) are moved toward one another by either:

(i) moving the receptacle (2) upwards, or (ii) by moving the lifting flange (26), the bar (27), the washing head carrier (9), the light barrier (25), and the washing head (5) downwards, or (iii) both (i) and (ii), until the lowermost ends of the washing cannulas (6) touch inner surfaces (15) of the well bottoms of the microplate (3) located in the receptacle (2), and registering a configuration of the microplate washing device (1) at which the washing cannulas (6) touch the inner surfaces (15) of the well bottoms as being a relative altitude value (13);

(b) after completing step (a), either:

(i) moving the receptacle (2), the washing head (5), the washing head carrier (9), and the light barrier (25) upwards, or (ii) moving the lifting flange (26) and the bar (27) downwards, or (iii) both (i) and (ii), until the bar (27) and the light barrier (25) move sufficiently with respect to each other that the bar (27) ceases to interrupt a light beam (34) of the light barrier (25), wherein the bar (27) and the washing head carrier (9) are engaged and move together during step (a), and separate from and move away from each other during step (b);

(c) registering a position of the lifting flange (26) at which the light beam (34) is no longer interrupted by the bar (27) due to the movement of the light barrier (25) and/or movement of the bar (27) as recited in step (b) as being a determined altitude position (29) of the lifting flange (26) using the sensor device (11) and the controller (12);

(d) determining and registering a correction amount (28), wherein the correction amount (28) is determined by calculating a difference in position of the lifting flange (26) at the relative altitude value (13) as compared to the determined altitude position (29); and wherein the correction amount (28) corresponds to a distance that the bar (27) and lifting flange (26) separate from the washing head carrier (9) during step (b); and (e) starting with the microplate washing device (1) at the determined altitude position (29): the controller (12) causes the microplate washing device (1) to move the receptacle (2) and/or the lifting flange (26) by the correction amount (28) plus a working distance (22) such that the lowermost ends of the washing cannulas (6) are brought to an active altitude (14) and are spaced by the working distance (22) from the inner surfaces (15) of the well bottoms of the microplate (3) located in the receptacle (2);

wherein when the lifting flange (26) is moved in step (e) said movement of the lifting flange (26) is upward movement, and wherein when the receptacle (2) is moved in step (e) said movement of the receptacle (2) is downward movement.

2. The setting method of claim 1, wherein the working distance (22) is either input by a user, or is a stored value which is retrieved by the controller (12).

3. The setting method claim 1, wherein the sensor device (11) comprises a touch sensor, which is selected from the group which comprises electromechanical sensors and electrical contacts.

4. The setting method of claim 1, wherein the sensor device (11) comprises a contactless sensor, which is selected from the group capacitive proximity switches, Hall sensors and light barriers.

5. The setting method of claim 1, wherein the setting method is carried out automatically during operation of the microplate washing device (1).

6. The setting method of claim 1, the method further comprising:

(i) during step (a): lowering the lifting flange (26), the bar (27), the washing head carrier (9), the light barrier (25), and the washing head (5) together until the washing cannulas (6) contact microplate (3) well bottoms and the washing head (5) therefore stops moving and does not lower further, and registering the configuration of the microplate washing device (1) when the washing head (5) stops moving as the relative altitude value (13);

(ii) during step (b): further lowering the lifting flange (26) and the bar (27), which lowers the bar (27) with respect to the light barrier (25), until the light barrier (25) communicates that the light beam is no longer interrupted by the bar (27);

(iii) during step (c): registering the configuration of the microplate washing device (1) when the light beam (34) is no longer interrupted by the bar (27) as the determined altitude position (29); and (iv) during step (d): determining the correction amount (28), wherein the correction amount (28) is the difference in position of the lifting flange (26) at the relative altitude value (13) as compared to the determined altitude position (29); and wherein the correction amount (28) corresponds to a distance that the bar (27) and lifting flange move downwards away from the washing head carrier (9) during step (b).

7. The setting method of claim 1:

wherein the lifting flange (26) is engaged to an elongated drive spindle (32);

wherein the drive spindle (32) is rotated by a motor (31); and wherein the lifting flange (26) is lowered and raised based on a direction of rotation of the drive spindle (32).

8. The setting method of claim 6, wherein the lifting flange (26) is engaged to an elongated drive spindle (32);

wherein the drive spindle (32) is rotated by a motor (31); and wherein the lifting flange (26) is lowered and raised based on a direction of rotation of the drive spindle (32).

9. The setting method of claim 1, wherein the washing head carrier (9) comprises a lifting bracket (35);

wherein the lifting bracket (35) comprises one or more slots (33) therein;

wherein the one or more slots (33) are shaped and positioned to receive and reversibly engage with the bar (27);

wherein the bar (27) is positioned in the one or more slots (33) and is engaged against the lifting bracket (35) during step (a); and wherein the bar (27) separates from the lifting bracket (35) and moves at least partially out of the one or more slots (33) during step (b).

10. The setting method of claim 6, wherein the washing head carrier (9) comprises a lifting bracket (35);

wherein the lifting bracket (35) comprises one or more slots (33) therein;

wherein the one or more slots (33) are shaped and positioned to receive and reversibly engage with the bar (27);

wherein the bar (27) is positioned in the one or more slots (33) and is engaged against the lifting bracket (35) during step (a); and wherein the bar (27) moves downwards, separates from the lifting bracket (35), and moves at least partially out of the one or more slots during step (b).

11. The setting method of claim 1:

wherein the lifting flange (26) is engaged to an elongated drive spindle (32);

wherein the drive spindle (32) is rotated by a motor (31);

wherein the lifting flange (26) is lowered and raised based on a direction of rotation of the drive spindle (32);

wherein during step (a): the lifting flange (26) is lowered by rotation of the drive spindle (32), and wherein the bar (27), the washing head carrier (9), the light barrier (25), and the washing head (5) also move downwards as a result of the lifting flange (26) being lowered; and wherein during step (b): the lifting flange (26) and the bar (27) are further lowered by rotation of the drive spindle (32), but the washing head carrier (9), the light barrier (25), and the washing head (5) are blocked from further downward movement because one or more washing cannulas (6) are standing on the inner surfaces (15) of microplate (3) well bottoms.

12. A method for configuring and operating a microplate washing device (1), wherein the method comprises:

providing a microplate (3), and a microplate washing device (1) comprising:

a receptacle (2) for receiving the microplate (3), the microplate (3) comprising a well array (4) with well bottoms;

a washing head (5) having washing cannulas (6), the washing cannulas (6) being arranged in an array corresponding to at least a part of the well array (4) of the microplate (3), the washing cannulas (6) having lowermost ends collectively defining a work plane (7);

a sensor device (11) comprising a light barrier (25);

a washing head carrier (9), the washing head carrier (9) being fixed to both the washing head (5) and to the light barrier (25);

a controller (12) operationally linked to the sensor device (11), which controller (12) processes signals of the sensor device (11) and controls movements of the receptacle (2) and/or of the washing head (5) of the microplate washing device (1); and a bar (27) fixed to a lifting flange (26), wherein the bar (27) is positioned for supporting the washing head carrier (9) from below but is not fixed to the washing head carrier (9) and is capable of disengaging from the washing head carrier (9);

wherein the work plane (7), which is defined by the lowermost ends of the washing cannulas (6), and a reference plane (8), which is defined by inner surfaces (15) of the well bottoms of the microplate (3), are arranged parallel to one another, and wherein a configuring portion of the method comprises the following steps:

(a) with the light barrier (25) interrupted by the bar (27), the receptacle (2) and the washing head (5) are moved toward one another by either:

(i) moving the receptacle (2) upwards, (ii) moving the lifting flange (26), the bar (27), the washing head carrier (9), the light barrier (25), and the washing head (5) downwards, or (iii) both (i) and (ii), until the lowermost ends of the washing cannulas (6) touch inner surfaces (15) of the well bottoms of a microplate (3) located in the receptacle (2), and registering a configuration of the microplate washing device (1) at which the washing cannulas (6) touch the inner surfaces (15) of the well bottoms as being a relative altitude value (13);

(b) after completing step (a), either:

(i) moving the receptacle (2), the washing head (5), the washing head carrier (9), and the light barrier (25) upwards, or (ii) moving the lifting flange (26) and the bar (27) downwards, or (iii) both (i) and (ii), until the bar (27) and the light barrier (25) move sufficiently with respect to each other that the bar (27) ceases to interrupt the light beam (34) of the light barrier (25);

wherein the bar (27) and the washing head carrier (9) are engaged and move together during step (a), and separate from and move away from each other during step (b);

(c) registering a position of the lifting flange (26) at which position the light beam (34) is no longer interrupted by the bar (27) due to the movement of the light barrier (25) and/or of the bar (27) as recited in step (b) as being a determined altitude position (29) of the lifting flange (26) using the sensor device (11) and the controller (12); and (d) determining and registering a correction amount (28), wherein the correction amount (28) is determined by calculating a difference in position of the lifting flange (26) at the relative altitude value (13) as compared to the determined altitude position (29);

wherein the correction amount (28) corresponds to a distance that the bar (27) and lifting flange (26) separate from the washing head carrier during step (b);

wherein an operating portion of the method is executed after the configuring portion of the method, is repeated two or more times using the same correction amount (28) previously registered at step (d), and comprises the following steps:

(A) with the light beam (34) of the light barrier (25) interrupted by the bar (27), the lifting flange (26) and bar (27) are lowered and/or the receptacle (2) is raised until the light beam (34) is no longer interrupted by the bar (27);

(B) stopping said lowering of the lifting flange (26) and bar (27) and/or raising of the receptacle (2) once the light beam (34) is no longer interrupted by the bar (27); and (C) starting with the configuration of the microplate washing device (1) at the end of step (B): raising the lifting flange (26) and bar (27) and/or lowering the receptacle (2) a distance corresponding to the correction amount (28) plus a working distance (22), such that the lowermost ends of the washing cannulas (6) are brought to an active altitude (14) and are spaced by the working distance (22) from the inner surfaces (15) of the well bottoms of the microplate (3) located in the receptacle (2).

13. The setting method of claim 12, wherein the lifting flange (26) is engaged to an elongated drive spindle (32);

wherein the drive spindle (32) is rotated by a motor (31); and wherein the lifting flange (26) is lowered and raised based on a direction of rotation of the drive spindle (32).

14. The setting method of claim 12, wherein the washing head carrier (9) comprises a lifting bracket (35);

wherein the lifting bracket (35) comprises one or more slots (33) therein;

wherein the one or more slots (33) are shaped and positioned to receive and reversibly engage with the bar (27);

wherein the bar (27) is positioned in the one or more slots (33) and is engaged against the lifting bracket (35) during step (a); and wherein the bar (27) separates from the lifting bracket (35) and moves at least partially out of the one or more slots (33) during step (b).

15. The setting method of claim 12, wherein the lifting flange (26) is engaged to an elongated drive spindle (32);

wherein the drive spindle (32) is rotated by a motor (31);

wherein the lifting flange (26) is lowered and raised based on a direction of rotation of the drive spindle (32);

wherein during step (a): the lifting flange (26) is lowered by rotation of the drive spindle (32), and wherein the bar (27), the washing head carrier (9), the light barrier (25), and the washing head (5) also move downwards as a result of the lifting flange (26) being lowered; and wherein during step (b): the lifting flange (26) and the bar (27) are further lowered by rotation of the drive spindle (32), but the washing head carrier (9), the light barrier (25), and the washing head (5) are blocked from further downward movement because one or more washing cannulas (6) are standing on the inner surfaces (15) of microplate (3) well bottoms.

16. A method for setting a microplate washing device (1): the method comprising providing a microplate washing device (1) and a microplate (3), the microplate washing device (1) comprising:

a receptacle (2) for receiving the microplate (3) having a microplate (3) therein, the microplate (3) comprising a well array (4) with well bottoms;

a washing head (5) having washing cannulas (6), the washing cannulas (6) being arranged in an array corresponding to at least a part of the well array (4) of the microplate (3), the washing cannulas (6) having lowermost ends collectively defining a work plane (7);

a sensor device (11) comprising a light barrier (25);

a washing head carrier (9), the washing head carrier (9) being fixed to both the washing head (5) and to the light barrier (25);

a controller (12) operationally linked to the sensor device (11), which controller (12) processes signals of the sensor device (11) and controls movements of the receptacle (2) and/or of the washing head (5) of the microplate washing device (1); and a bar (27) fixed to a lifting flange (26), wherein the bar (27) is positioned for supporting the washing head carrier (9) from below but is not fixed to the washing head carrier (9) and is capable of disengaging from the washing head carrier (9);

wherein the work plane (7), which is defined by the lowermost ends of the washing cannulas (6), and a reference plane (8), which is defined by inner surfaces (15) of the well bottoms of the microplate (3), are arranged parallel to one another, and wherein the setting method comprises the following steps:

(a) with the light barrier (25) interrupted by the bar (27): the washing head (5) is moved downward towards the receptacle (2) by moving the lifting flange (26), the bar (27), the washing head carrier (9), the light barrier (25), and the washing head (5) downwards until the lowermost ends of the washing cannulas (6) touch inner surfaces (15) of the well bottoms of the microplate (3) located in the receptacle (2), and registering a configuration of the microplate washing device (1) at which the washing cannulas (6) touch the inner surfaces (15) of the well bottoms as being a relative altitude value (13);

(b) after completing step (a): further lowering the lifting flange (26) and the bar (27) until the bar (27) ceases to interrupt the light beam (34) of the light barrier (25), wherein the bar (27) and the washing head carrier (9) are engaged and move downwards together during step (a), and wherein the bar (27) moves downwards away from the washing head carrier (9) during step (b);

(c) registering a position of the lifting flange (26) at which position the light beam (34) is no longer interrupted by the bar (27) due to the movement of the bar (27) as recited in step (b) as being a determined altitude position (29) of the lifting flange (26) using the sensor device (11) and the controller (12);

(d) determining and registering a correction amount (28), wherein the correction amount (28) is determined by calculating a difference in position of the lifting flange (26) at the relative altitude value (13) as compared to the determined altitude position (29);

and wherein the correction amount (28) corresponds to a distance that the bar (27) and lifting flange (26) separate from the washing head carrier (9) during step (b); and (e) starting from the determined altitude position: the controller (12) causes the microplate washing device (1) to move the lifting flange (26) upwards by the correction amount (28) plus a working distance (22) such that the lowermost ends of the washing cannulas (6) are brought to an active altitude (14) and are spaced by the working distance (22) from the inner surfaces (15) of the well bottoms of the microplate (3) located in the receptacle (2).

17. The setting method of claim 16, wherein the lifting flange (26) is engaged to an elongated drive spindle (32);

wherein the drive spindle (32) is rotated by a motor (31); and wherein the lifting flange (26) is lowered and raised based on a direction of rotation of the drive spindle (32).

18. The setting method of claim 16, wherein the lifting flange (26) is engaged to an elongated drive spindle (32);

wherein the drive spindle (32) is rotated by a motor (31);

wherein the lifting flange (26) is lowered and raised based on a direction of rotation of the drive spindle (32);

wherein during step (a): the lifting flange (26) is lowered by rotation of the drive spindle (32), and wherein the bar (27), the washing head carrier (9), the light barrier (25), and the washing head (5) also move downwards as a result of the lifting flange (26) being lowered;

wherein during step (b): the lifting flange (26) and the bar (27) are further lowered by rotation of the drive spindle (32), but the washing head carrier (9), the light barrier (25), and the washing head (5) are blocked from further downward movement because one or more washing cannulas (6) are standing on the inner surfaces (15) of microplate (3) well bottoms.

19. The setting method of claim 16, wherein the washing head carrier (9) comprises a lifting bracket (35);

wherein the lifting bracket (35) comprises one or more slots (33) therein;

wherein the one or more slots (33) are shaped and positioned to receive and reversibly engage with the bar (27);

wherein the bar (27) is positioned in the one or more slots (33) and is engaged against the lifting bracket (35) during step (a); and wherein the bar (27) moves downwards, separates from the lifting bracket (35), and moves at least partially out of the one or more slots (33) during step (b).

* * * * *